US009945217B2

(12) United States Patent
Mullin et al.

(10) Patent No.: US 9,945,217 B2
(45) Date of Patent: Apr. 17, 2018

(54) SYSTEM AND METHOD FOR FLUID INJECTION

(71) Applicant: Cameron International Corporation, Houston, TX (US)

(72) Inventors: Michael David Mullin, Longford (IE); Kevin Peter Minnock, Houston, TX (US)

(73) Assignee: Cameron International Corporation, Houston, TX (US)

( * ) Notice: Subject to any disclaimer, the term of this patent is extended or adjusted under 35 U.S.C. 154(b) by 297 days.

(21) Appl. No.: 14/681,971

(22) Filed: Apr. 8, 2015

(65) Prior Publication Data

US 2016/0215603 A1 Jul. 28, 2016

Related U.S. Application Data

(60) Provisional application No. 62/107,305, filed on Jan. 23, 2015.

(51) Int. Cl.

| | |
|---|---|
| ***E21B 33/068*** | (2006.01) |
| ***E21B 33/076*** | (2006.01) |
| ***E21B 43/16*** | (2006.01) |
| ***E21B 43/25*** | (2006.01) |

(52) U.S. Cl.

CPC ..... *E21B 43/16* (2013.01); *E21B 33/068* (2013.01); *E21B 33/076* (2013.01); *E21B 43/25* (2013.01)

(58) Field of Classification Search

CPC ..... E21B 33/068; E21B 33/076; E21B 43/16; E21B 43/25

See application file for complete search history.

(56) References Cited

U.S. PATENT DOCUMENTS

| | | | | |
|---|---|---|---|---|
| 3,378,074 | A * | 4/1968 | Kiel | C09K 8/64 137/13 |
| 3,730,273 | A * | 5/1973 | Wilson | E21B 43/14 166/269 |
| 4,274,749 | A | 6/1981 | Lake et al. | |
| 4,276,904 | A | 7/1981 | Jackson | |
| 4,386,806 | A * | 6/1983 | Axen | E21B 43/28 166/295 |

(Continued)

FOREIGN PATENT DOCUMENTS

| | | | |
|---|---|---|---|
| EP | 0119665 | A2 | 9/1984 |
| WO | 2014/178723 | A1 | 11/2014 |
| WO | 2015112908 | A2 | 7/2015 |

OTHER PUBLICATIONS

PCT International Search Report & Written Opinion; Application No. PCT/US2016/014605; dated May 12, 2016; 12 pages.

(Continued)

*Primary Examiner* — Matthew R Buck
(74) *Attorney, Agent, or Firm* — Fletcher Yoder, P.C.

(57) ABSTRACT

A fluid injection system includes a water injection assembly having a choke valve configured to receive water from a water injection line and to provide the water to a main bore of a well head. The system also includes a polymer injection assembly having a dedicated polymer connection configured to receive a polymer from a polymer injection line and to direct the polymer toward the main bore of the well head to facilitate mixing of the water and the polymer within the main bore.

18 Claims, 6 Drawing Sheets

(56) References Cited

U.S. PATENT DOCUMENTS

| | | | | |
|---|---|---|---|---|
| 4,683,951 | A * | 8/1987 | Pathak | C09K 8/58 166/245 |
| 4,687,059 | A * | 8/1987 | Pathak | E21B 43/17 166/270.1 |
| 5,067,508 | A * | 11/1991 | Lee | F17D 1/17 137/13 |
| 9,528,350 | B2 * | 12/2016 | Lunde | C02F 1/686 |
| 2009/0242201 | A1 | 10/2009 | Van Beurden | |
| 2011/0220354 | A1 * | 9/2011 | Eikaas | B01F 3/1271 166/275 |
| 2011/0232907 | A1 * | 9/2011 | Bryant | B01F 5/0659 166/300 |
| 2014/0262283 | A1 * | 9/2014 | Savari | E21B 43/25 166/305.1 |
| 2015/0275611 | A1 * | 10/2015 | Minnock | E21B 33/076 166/368 |
| 2015/0275612 | A1 * | 10/2015 | Minnock | E21B 33/076 166/368 |
| 2015/0275613 | A1 * | 10/2015 | Minnock | E21B 33/076 166/368 |
| 2015/0275614 | A1 * | 10/2015 | Minnock | E21B 33/076 166/368 |

OTHER PUBLICATIONS

U.S. Appl. No. 14/681,990, filed Apr. 8, 2015, Michael David Mullin.

* cited by examiner

SYSTEM AND METHOD FOR FLUID INJECTION

CROSS-REFERENCE TO RELATED APPLICATION

This application claims the benefit of U.S. Provisional Patent Application No. 62/107,305, filed Jan. 23, 2015, entitled "SYSTEM AND METHOD FOR FLUID INJECTION," which is incorporated by reference herein in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Wells are often used to access resources below the surface of the earth. For instance, oil, natural gas, and water are often extracted via a well. Some wells are used to inject materials below the surface of the earth, e.g., to sequester carbon dioxide, to store natural gas for later use, or to inject steam or other substances near an oil well to enhance recovery. Due to the value of these subsurface resources, wells are often drilled at great expense, and great care is typically taken to extend their useful life. Chemical injection systems are often used to maintain a well and/or enhance well output. For example, chemical injection systems may inject chemicals to extend the life of a well or to increase the rate at which resources are extracted from a well.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
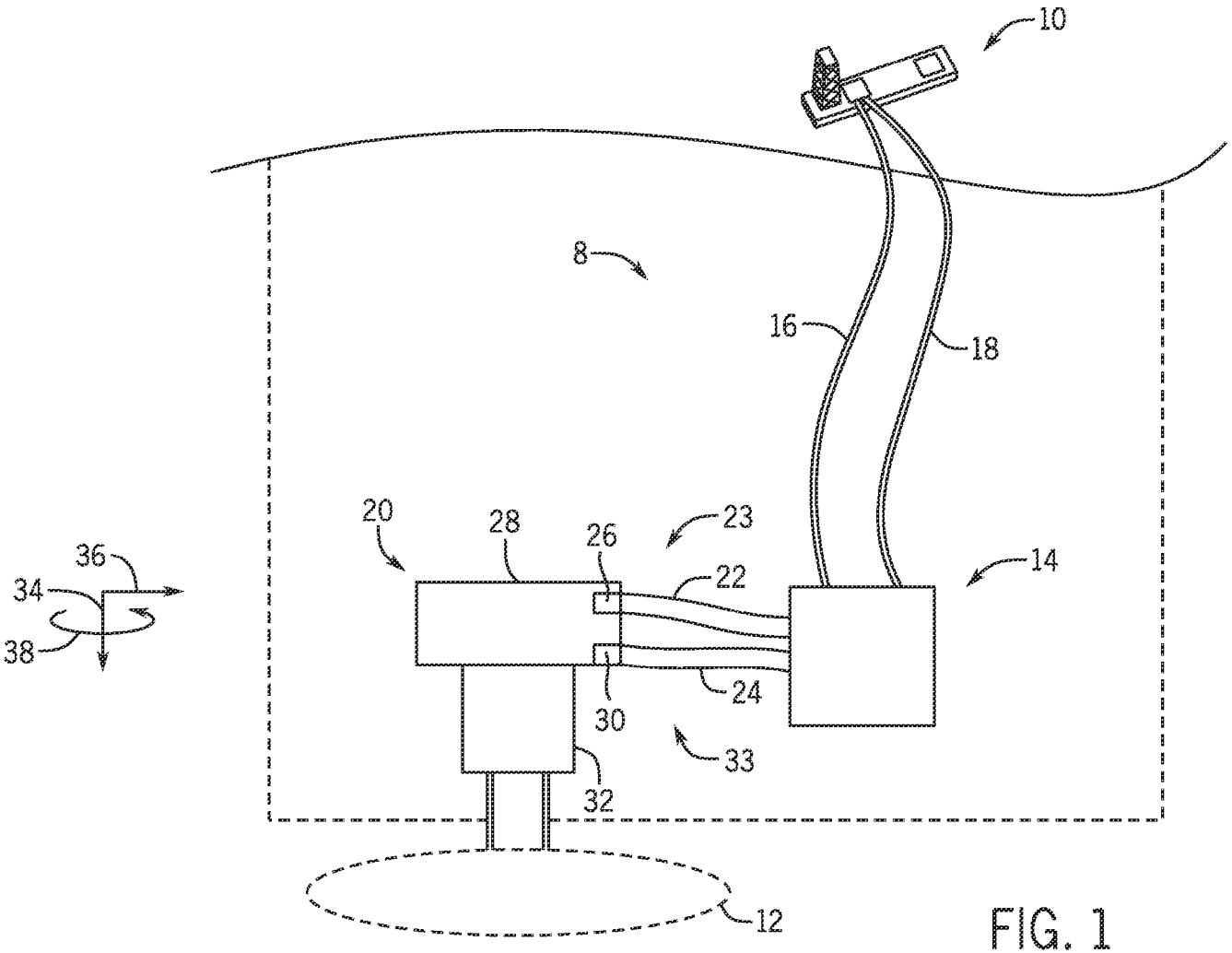
FIG. 1 is a schematic of an embodiment of a fluid injection system, in accordance with an embodiment of the present disclosure.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments are generally directed to systems and methods for fluid injection. More particularly, the present embodiments are directed to systems and methods for reducing chemical degradation during supply and injection of the chemical into a well and a mineral formation. In some cases, the chemical may be a liquid or powder long-chain polymer or other polymer. When mixed with a processing fluid (e.g., water), the polymer may increase the viscosity of the water, and the viscous mixture of polymer and water may be utilized to improve flow of production fluids in the mineral formation. As will be appreciated, a polymer may be delivered to a site (e.g., a floating production storage and offloading (FPSO) unit or other floating vessel) as an emulsion product. That is, the polymer (e.g., long-chain polymer) may be tightly coiled within water droplets and may have a low viscosity. Prior to injection into the mineral formation, it may be desirable to invert the polymer (e.g., invert the emulsion) by mixing the polymer with water, for example, to uncoil the polymer chains into a ribbon form. However, when the polymer is in ribbon form, the polymer may be susceptible to shear forces and acceleration forces that can cause the polymer to degrade, and therefore be less effective and viscous. Without the disclosed embodiments, fluid injection systems may mix the polymer with the water, thereby inverting the polymer, prior to injection into a well. The mixture of polymer and water may be injected into the well via a choke valve or other flow control device that subjects the mixture to large pressure changes, shear forces, and/or acceleration forces, for example. However, such fluid injection systems may cause degradation of the polymer and may make the mixture of polymer and water less viscous and less effective.

As mentioned above, the polymer may be a long-chain polymer, which may be susceptible to shear forces and/or acceleration forces when inverted. Thus, flowing the polymer through a choke valve or similar flow control components while the polymer is in ribbon form may result in degradation of the polymer. To reduce degradation of the polymer caused by shear forces and/or acceleration forces, the disclosed embodiments are configured to flow the polymer, in a non-inverted state or a substantially non-inverted state (e.g., less than approximately 1, 2, 3, 4, 5, 10, 15, 20, 25, 30, 35, 40, 45, or 50 percent inverted), into the well head via a polymer injection assembly having a dedicated polymer connection (e.g., a polymer injection choke valve, a distributed polymer injection system, various dedicated polymer valves and/or conduits, or the like). A water injection fluid (e.g., water) may be injected separately into the well head via a water injection assembly having a water injection choke valve. The polymer and the water mix within a main bore (e.g., production bore) of the well head, thereby inverting the polymer within the main bore and/or inverting the polymer as the polymer and water mixture travels within the main bore toward the mineral formation. Notably, in certain embodiments, the polymer does not mix with the water prior to injection of the polymer into the main bore, and thus, the polymer is not inverted prior to injection of the polymer into the main bore. Advantageously, in certain embodiments, the polymer is not inverted and then subjected to the high pressure drop across the water injection choke valve, which may cause polymer degradation.

With the foregoing in mind, FIG. 1 is a schematic illustrating an embodiment of a fluid injection system 8. As shown, a topside unit 10 (e.g., floating production storage and offloading (FPSO)), may supply one or more injection fluids (e.g., water, polymer, etc.) to a subsea mineral formation 12. In particular, the water may be supplied to a subsea distribution unit 14 via a water supply line 16 and the polymer may be supplied to the subsea distribution unit 14 via a polymer supply line 18. Additionally, the water may be distributed from the subsea distribution unit 14 to a well 20 via a water injection line 22 and the polymer may be distributed from the subsea distribution unit 14 to the well 20 via a polymer injection line 24. As discussed in more detail below, a water injection assembly 23 may include a water injection choke valve 26 disposed in what is colloquially referred to as a "christmas" tree 28 (e.g., tree) to facilitate flow of the water into a well head 32. Additionally, a polymer injection assembly 33 may include a dedicated polymer connection 30 (e.g., a valve, a distributed polymer injection system, or the like) disposed in the tree 28 to facilitate independent flow of the polymer into the well head 32. Thus, the water and the polymer are isolated (e.g., separated) from one another and are not mixed outside of the well 20 (e.g., the well head 32 and/or the tree 28). Additionally, the polymer flows into the well 20 in a non-inverted state (e.g., in a substantially non-inverted state or less than approximately 1, 2, 3, 4, 5, 10, 15, 20, 25, 30, 35, 40, 45, or 50 percent inverted) and is inverted (e.g., substantially completely inverted or greater than approximately 30, 40, 50, 60, 70, 80, 90 or 100 percent inverted) within a main bore of the well 20 downstream of the water injection choke valve 26 and the dedicated polymer connection 30. In some embodiments, at least 10, 20, 30, 40, 50, 60, 70, 80, 90, or 100 percent of the total inversion that occurs during injection of the polymer into the well 20 occurs at or within the main bore 42 of the tree 28 and/or the well head 32 and/or downhole of these components prior to reaching the mineral formation 12.

To facilitate discussion, the well 20 may be described with reference to an axial axis or direction 34, a radial axis or direction 36, and a circumferential axis or direction 38. The water injection choke valve 26 and the dedicated polymer connection 30 may be positioned at any suitable axial positions (e.g., along the axial axis 34) and/or circumferential positions (e.g., along the circumferential axis 38). Various relative positions of these components about the axial axis 34 and/or the circumferential axis 38 may facilitate mixing of the polymer and the water within a main bore of the well 20. By way of non-limiting example, in the illustrated embodiment, the water injection choke valve 26 is positioned at a first axial location (e.g., along the axial axis 34) of the well 20, and the dedicated polymer connection 30 is positioned at a second axial location (e.g., along the axial axis 34) of the well 20. Such a configuration may enable the water to enter a main bore of the well 20 at the first axial location and the polymer to enter the main bore at the second axial location. As shown, the first axial location is upstream from the second axial location, although in other embodiments the first axial location may be downstream from the second axial location or at the same axial location.

Additionally, as discussed in more detail below, the dedicated polymer connection 30 may include any suitable components and have any suitable configuration to facilitate independent flow of the polymer from the polymer injection line 24 into the well 20. For example, the dedicated polymer connection 30 may include a valve (e.g., a polymer injection choke valve) or other flow control device configured to adjust the flow of the polymer from the polymer injection line 24 into a main bore of the well 20. By way of another example, the dedicated polymer connection 30 may include multiple valves (e.g., a distributed polymer injection system) configured to distribute the polymer into a main bore of the well 20 at multiple axial positions (e.g., along the axial axis 34) and/or circumferential positions (e.g., along the circumferential axis 38). Furthermore, in some embodiments, the dedicated polymer connection 30 may include various components (e.g., valves and/or conduits) configured to direct the polymer into an annulus (e.g., an A-annulus) or other conduit (e.g., bore) of the well 20 and to subsequently direct the polymer from the annulus into a main bore of the well 20 at one or more axial positions (e.g., along the axial axis 34). Regardless of the configuration, the dedicated polymer connection 30 may enable independent flow of the polymer into the well 20 (e.g., separately from the water), such that the polymer remains in a non-inverted state or a substantially non-inverted state until mixing with the water in the main bore of the well 20 and is not generally subject to degradation during supply and injection of the polymer into the well 20. In some embodiments, a controller may be provided to control an actuator to adjust the water injection choke valve 26, an actuator to adjust one or more features of the dedicated polymer connection 30, a flow rate of the water through the water injection line 22, and/or a flow rate of the polymer through the polymer injection line 24 to control and/or to facilitate mixing and inversion of the polymer.

Although one subsea distribution unit 14 and one well 20 are shown in FIG. 1 to facilitate discussion, it should be understood that the water may be supplied by the topside unit 10 to multiple subsea distribution units 14 via respective water supply lines 16 and/or the polymer may be supplied by the topside unit 10 to multiple subsea distribution units 14 via respective polymer supply lines 18. Additionally, the water may be distributed from each subsea distribution unit 14 to multiple wells 20 via respective water injection lines 22 and/or the polymer may be distributed from each subsea distribution unit 14 to multiple wells 20 via respective polymer injection lines 24. In certain embodiments, the topside unit 10 may supply the water and the polymer directly to the well 20, e.g., via the water supply line 16 and the polymer supply line 18, respectively, without use of the subsea distribution unit 14. Further, the embodiments disclosed herein may be adapted for use with surface wells (e.g., the polymer and water may be distributed separately to a surface well and may mix within a main bore of the surface well).

Figure 2:
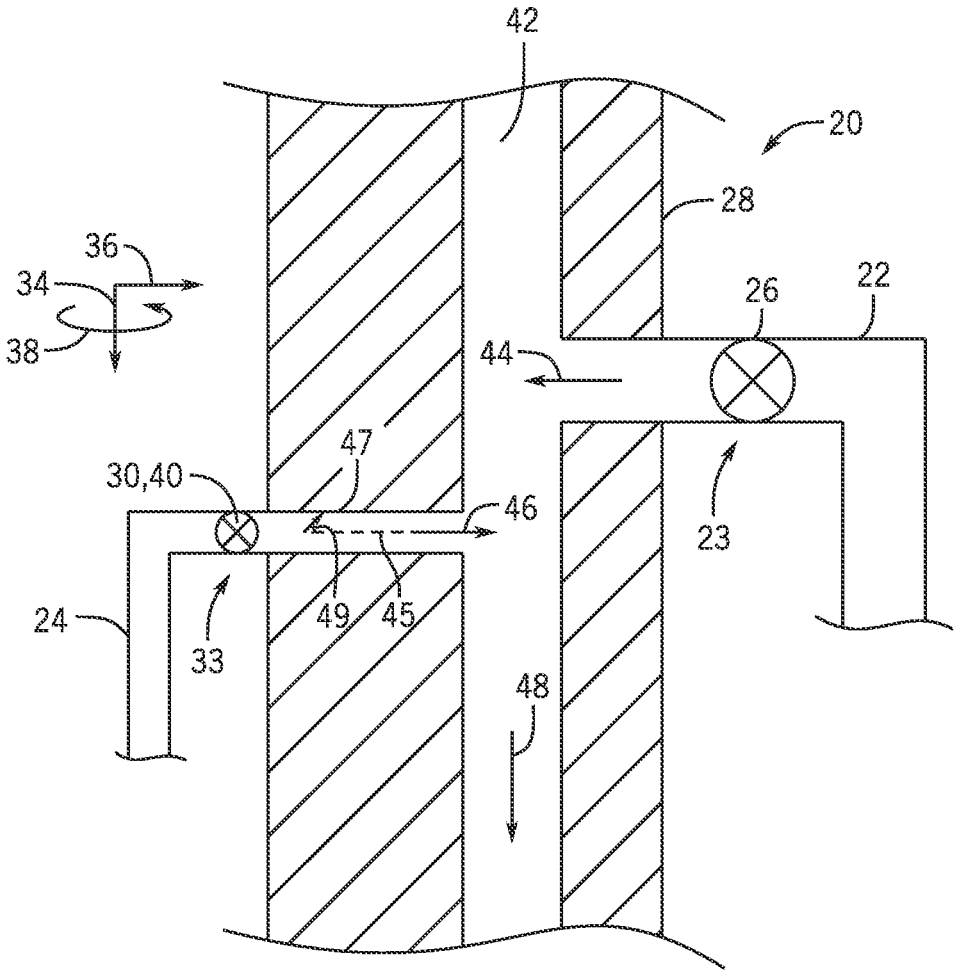
FIG. 2 is a cross-sectional side view of a portion of a tree coupled to a water injection assembly and to a polymer injection assembly having a distributed polymer injection system, in accordance with an embodiment.

FIG. 2 is a cross-sectional side view of a portion of the tree 28 coupled to the water injection assembly 23 and to the polymer injection assembly 33, in accordance with an embodiment. Although the tree 28 is shown, in some embodiments, the water injection assembly 23 and/or the polymer injection assembly 33 may be coupled to other portions of the well 20, such as the well head 32. The water injection assembly 23 includes the water injection line 22 and the water injection choke valve 26 or other flow control device, while the polymer injection assembly 33 includes the polymer injection line 24 and the dedicated polymer connection 30. Additionally, in the illustrated embodiment, the dedicated polymer connection 30 includes a polymer injection choke valve 40 or other flow control device.

The water injection choke valve 26 is configured to receive the water from the water injection line 22 and to inject the water into a main bore 42 (e.g., production bore), as shown by arrow 44. The polymer injection choke valve 40 is configured to receive the polymer from the polymer injection line 24 and to inject the polymer, in a non-inverted state or a substantially non-inverted state, into the main bore 42, as shown by arrow 46. The water injection choke valve 26 and/or the polymer injection choke valve 40 may be adjustable (e.g., via a manual actuator or an electrical, hydraulic, or pneumatic actuator controlled by a controller) to adjust (e.g., increase or decrease) a flow rate of the fluid (i.e., the water or the polymer, respectively) and/or a pressure drop of the fluid as the fluid flows through the water injection choke valve 26 and/or the polymer injection choke valve 40. For example, in certain embodiments of the water injection choke valve 26 and/or the polymer injection choke valve 40, a cross-sectional area of the flow path of the choke trim may be adjustable (e.g., increased or decreased) and/or a length of the flow path of the choke trim may be adjustable (e.g., increased or decreased). As will be appreciated, adjusting the cross-sectional area of the flow path may adjust the flow rate of the fluid through the choke trim, and adjusting the length of the flow path may adjust the pressure drop of the fluid as the fluid flows through the choke trim.

As discussed above, it may be desirable to inject the water and the polymer into the main bore 40 at different axial positions (e.g., along the axial axis 34) and/or at different circumferential positions (e.g., along the circumferential axis 38) to facilitate mixing of the water and the polymer within the main bore 42. The time for the polymer to invert after being exposed to water may vary based on certain factors, such as the type of polymer, for example. Thus, the axial position of the at which the polymer enters the main bore 42 relative to the axial position at which the water enters the main bore 42 and/or relative to the mineral formation 12 may vary based on the type of polymer utilized and/or other factors to facilitate complete or substantially complete inversion (e.g., at least 30, 40, 50, 60, 70, 80, 90, or 100 percent inversion) of the polymer within the main bore 42 and prior to reaching the mineral formation 12. By way of example, in the illustrated embodiment, the water enters the main bore 42 at a first axial position (e.g., along the axial axis 34) and the polymer enters the main bore 42 at a second axial position (e.g., along the axial axis 34). Additionally, as shown, the water enters the main bore 42 at a first circumferential position (e.g., along the circumferential axis 38) and the polymer enters the main bore 42 at a second axial position (e.g., along the circumferential axis 38). As shown, the first axial position at which the water enters the main bore 42 is upstream from the second axial position at which the polymer enters the main bore 42, although in other embodiments, the first axial position at which the water enters the main bore 42 may be downstream from or the same as the second axial position. However, it should be understood that the various components (e.g., the water injection line 22, the water injection choke valve 26, the polymer injection line 24, the polymer injection choke valve 40) may be disposed at any suitable locations and may inject the water and the polymer at any suitable positions relative to the main bore 42 and/or relative to one another to facilitate mixing of the water and the polymer within the main bore 42.

Although an axis 45 of a conduit 47 of the polymer injection assembly 33 is shown as generally aligned with the radial axis 36 and generally perpendicular to the axial axis 34, in certain embodiments, the conduit 47 may be oriented at an angle 49 (e.g., approximately 5, 10, 15, 20, 25, 30, 35, 40, or 45 degrees, or between approximately 5-75, 10-60, 20-50, or 30-45 degrees) relative to the radial axis 36, thereby enabling the polymer to be injected into the main bore 42 in an upstream (e.g., angled upstream) or downstream (e.g., angled downstream) flow direction. Additionally, in some embodiments, the conduit 47 may be oriented relative to the main bore 42 to inject the polymer in the circumferential direction 38 about the axial axis 34 to induce swirl. The conduit 47 may be oriented at any suitable angle 49 relative to the radial axis 36, and/or at any suitable angle relative to the axial axis 34 and/or angled in the circumferential direction to enable flow of the polymer into the main bore 42 to facilitate mixing and inversion of the polymer within the main bore 42. In some embodiments, the conduit 47 may be positioned radially across from the water injection choke valve 26 and/or from an additional polymer injection assembly 33 to induce impingement (e.g., contact or collision) within the main bore 42 and thereby facilitate mixing and inversion of the polymer.

While the polymer injection assembly 33 illustrated in FIG. 2 includes one polymer injection line 24 and one polymer injection choke valve 40 configured to inject the polymer into the main bore 42 at one axial position to facilitate discussion, in other embodiments, the polymer injection assembly 33 may be configured to inject the polymer into the main bore 42 at multiple axial and/or circumferential positions and/or angles. For example, one or more polymer injection lines 24 may be coupled to multiple polymer injection choke valves 40 distributed axially (e.g., along the axial axis 34) and/or circumferentially (e.g., along the circumferential axis 38) about the main bore 42 and/or oriented at any suitable angles. Such a configuration may enable injection of the polymer, in the non-inverted state or a substantially non-inverted state, into the main bore 42 at multiple different injection positions and/or at multiple different angles, which may facilitate mixing of the polymer with the water within the main bore 42. In some such cases, each of the multiple polymer injection choke valves 40 may be independently controlled (e.g., via a controller) to independently adjust an injection rate and/or pressure of the polymer at each injection position. Furthermore, any of the embodiments and various features disclosed herein may be used in any suitable combination and/or combined in any suitable manner.

Regardless of the configuration, the water injection assembly 23 and the polymer injection assembly 33 having the polymer injection choke valve 40 enable separate (e.g., independent) injection of these fluids into the main bore 42, and therefore, the water and the polymer do not mix prior to injection into the main bore 42. Furthermore, the polymer flows through the polymer injection choke valve 40 and into the main bore 42 in the non-inverted state or a substantially non-inverted state, and degradation of the polymer is thereby limited during supply and injection of the polymer into the main bore 42. The polymer and water mix within the main bore 42, causing the polymer to invert within the main bore 42 and/or as the polymer and water mixture travels within the main bore 42 toward the mineral formation, as shown by arrow 48. As noted above, the polymer and water mixture may improve flow of production fluids in the mineral formation.

Figure 3:
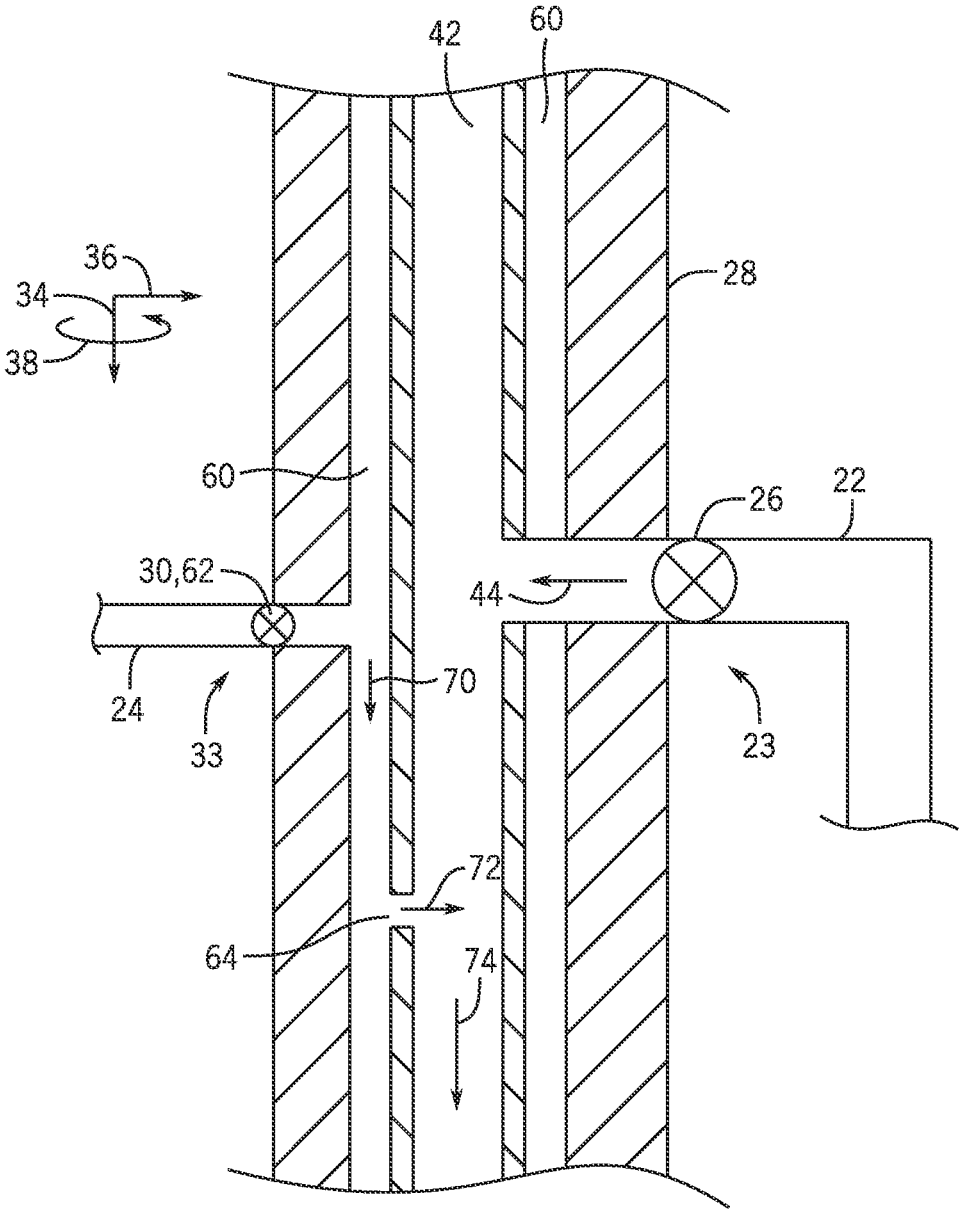
FIG. 3 is a cross-sectional side view of a portion of a tree coupled to a water injection assembly and to a polymer injection assembly configured to flow a polymer through an annulus of the tree.

FIG. 3 is a cross-sectional side view of a portion of the tree 28 coupled to the water injection assembly 23 and to the polymer injection assembly 33 having the dedicated polymer connection 30 configured to flow the polymer into an annulus 60 (e.g., an A-annulus) of the tree 28, in accordance with an embodiment. Although the tree 28 is shown, in some embodiments, the water injection assembly 23 and/or the polymer injection assembly 33 may be coupled to other portions of the well 20, such as the well head 32. As discussed above with respect to FIG. 2, the water injection assembly 23 includes the water injection line 22 and the water injection choke valve 26, while the polymer injection assembly 33 includes the polymer injection line 24 and the dedicated polymer connection 30. Additionally, in the illustrated embodiment, the dedicated polymer connection 30 includes a valve 62 (e.g., a polymer injection choke valve) or other flow control device configured to flow the polymer into the annulus 60. The polymer is distributed from the annulus 60 to the main bore 42 via a conduit 64 (e.g., a radial conduit or perforation in a wall of the main bore 42).

The water injection choke valve 26 is configured to receive the water from the water injection line 22 and to inject the water into a main bore 42 (e.g., production bore), as shown by arrow 44. As shown, the polymer injection choke valve 62 receives the polymer from the polymer injection line 24 and injects the polymer into the annulus 60. The annulus 60 may be an A-annulus or any other suitable annulus or conduit within the tree 28 or other component of the well 20, such as the well head 32. As shown, the annulus 60 extends generally axially (e.g., in the axial direction 34), is annular in shape, and is generally concentric with the main bore 42. The polymer may flow through the annulus 60, as shown by arrow 70, toward the radial conduit 64 extending between and fluidly coupling the annulus 60 and the main bore 42. The polymer may then flow into the main bore 42, as shown by arrow 72. Advantageously, independent connection between the polymer injection line 24 and the annulus 60 (e.g., via the polymer injection choke valve 62) may enable a pressure in the annulus 60 to be controlled to facilitate flow of the polymer into the main bore 42 and mixing with the water within the main bore 42 without subjecting the polymer to a large pressure differential.

Additionally, as shown, the water is injected into the main bore 42 at the first axial position, which may be the same as or different from (e.g., upstream or downstream from) the second axial position at which the radial conduits 64 injects the polymer into the main bore 42. In the illustrated embodiment, the first axial position is upstream from the second axial position at which the radial conduit 64 injects the polymer into the main bore 42. However, as noted above, the various components (e.g., the water injection line 22, the water injection choke valve 26, the polymer injection line 24, the valve 62, the radial conduit 64) may be disposed at any suitable locations and may inject the water and the polymer at any suitable positions relative to the main bore 42 and/or relative to one another to facilitate mixing of the water and the polymer within the main bore 42. In a similar manner as discussed above, the radial conduit 62 may be oriented at any suitable angle relative to the radial axis 36 and/or relative to the axial axis 34, thereby enabling the polymer to be injected into the main bore 42 in an upstream (e.g., angled upstream), downstream (e.g., angled downstream), and/or circumferential flow direction. Thus, the radial conduit 64 may be oriented at any suitable angle to enable flow of the polymer into the main bore 42 to facilitate mixing and inversion of the polymer.

Figure 4:
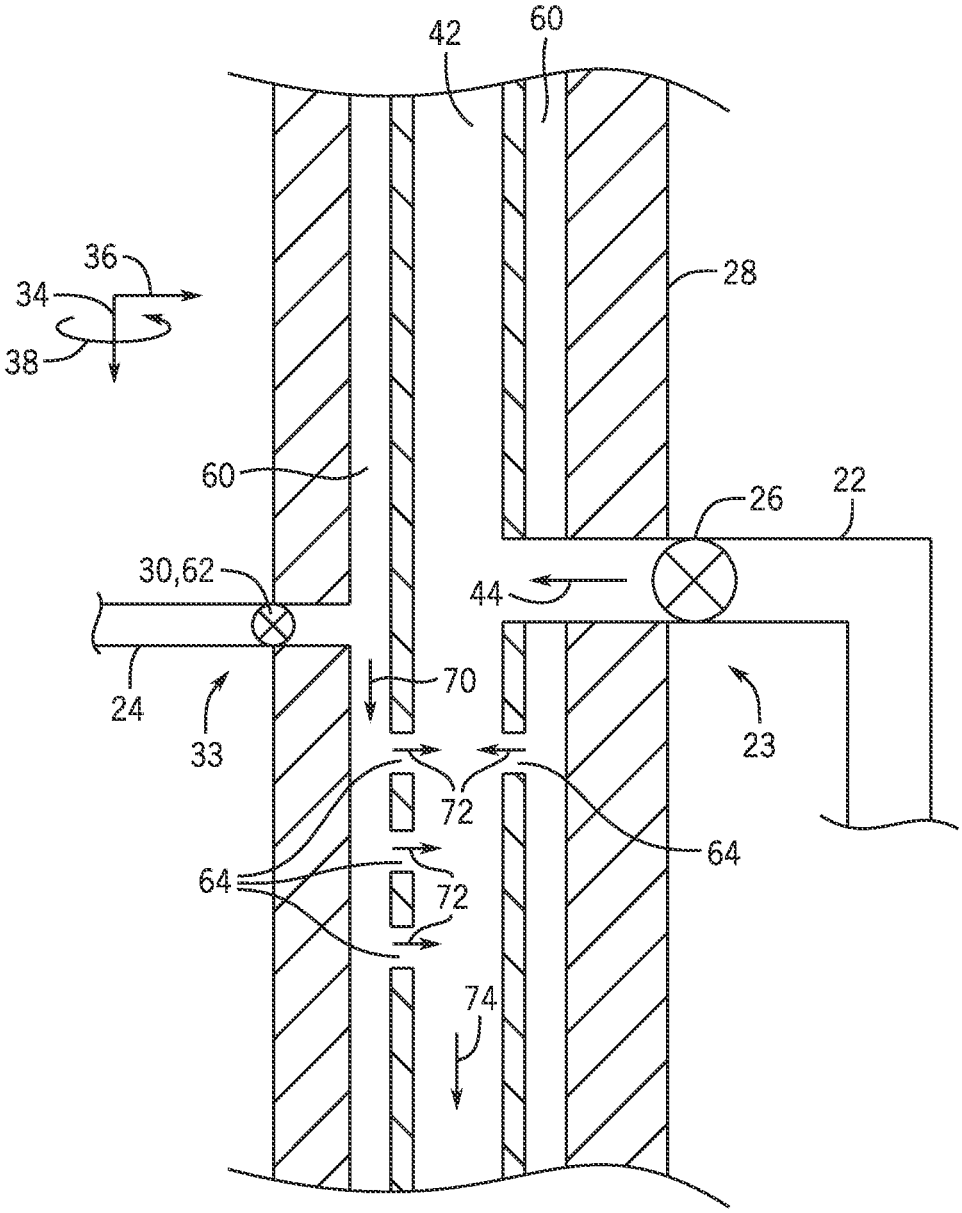
FIG. 4 is a cross-sectional side view of a portion of a tree coupled to a water injection assembly and to a polymer injection assembly configured to flow a polymer through an annulus of the tree, wherein multiple radial conduits couple the annulus to a main bore of a well.

FIG. 4 is a cross-sectional side view of a portion of the tree 28 coupled to the water injection assembly 23 and to the polymer injection assembly 33 configured to flow the polymer through the annulus 60 of the tree 28, wherein multiple radial conduits 74 couple the annulus 60 to a main bore 42. Although the tree 28 is shown, in some embodiments, the water injection assembly 23 and/or the polymer injection assembly 33 may be coupled to other portions of the well 20, such as the well head 32. The illustrated embodiment includes four radial conduits 64, although any other suitable number (e.g., 2, 3, 4, 5, 6, 7, 8, 9, 10, or more) of radial conduits 64 may extend between the annulus 60 and the main bore 42. Additionally, in certain embodiments, multiple radial conduits 64 extending between the annulus 60 and the main bore 42 may be axially and/or circumferentially spaced apart (e.g., at discrete locations along the axial axis 34 and/or along the circumferential axis 38) from one another in any suitable manner, thereby enabling the polymer to flow from the annulus 60 into the main bore 42 at multiple axial positions (e.g., along the axial axis 34) and/or at multiple circumferential positions (e.g., along the circumferential axis 38). In a similar manner as discussed above, each of the radial conduits 64 may be oriented at any suitable angle relative to the radial axis 36 and/or relative to the axial axis 34, thereby enabling the polymer to be injected into the main bore 42 in an upstream (e.g., angled upstream), downstream (e.g., angled downstream), and/or circumferential flow direction. Thus, the radial conduits 64 may be oriented at any suitable angle to enable flow of the polymer into the main bore 42 to facilitate mixing and inversion of the polymer. FIG. 4 also illustrates one of the possible configurations of radial conduits 64 discussed above in which multiple conduits 64 are positioned radially across from one another to induce impingement (e.g., contact or collision) of polymer injected by these conduits 64 within the main bore 42 and thereby facilitate mixing and inversion of the polymer.

As noted above, regardless of the configuration, the water injection assembly 23 and the polymer injection assembly 33 having the polymer injection choke valve 62 configured to flow the polymer into the annulus 60, as shown in FIGS. 3 and 4, enable separate (e.g., independent) injection of these fluids into the main bore 42, and therefore, the water and the polymer do not mix prior to injection into the main bore 42. Furthermore, the polymer flows through the polymer injection choke valve 62, the annulus 60, and/or the one or more radial conduits 64 and into the main bore 42 in the non-inverted state, and degradation of the polymer is thereby limited during supply and injection of the polymer into the main bore 42. The polymer and water mix within the main bore 42, causing the polymer to invert within the main bore 42 and/or as the polymer and water mixture travels within the main bore 42 toward the mineral formation, as shown by arrow 74. As noted above, the polymer and water mixture may improve flow of production fluids in the mineral formation.

Figure 5:
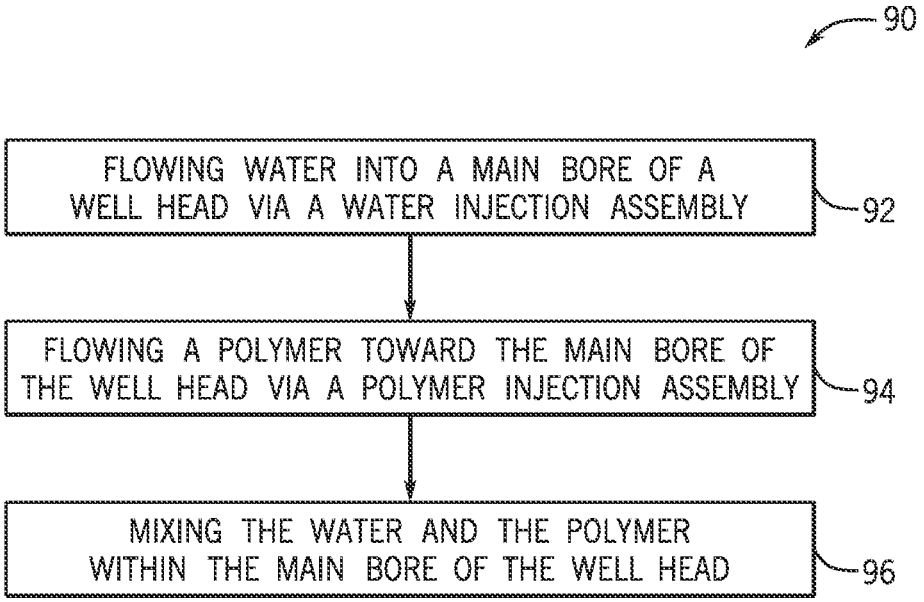
FIG. 5 is a flow diagram of an embodiment of a method for injecting a polymer into a well.

FIG. 5 is a flow diagram of an embodiment of a method 90 for injecting the polymer into the well 20. The water flows into the main bore 42 of the well head 32 via the water injection assembly 23, in step 92. The polymer, in a non-inverted state or a substantially non-inverted state, flows toward the main bore 42 of the well head 32 via the polymer injection assembly 33, in step 94. The water and the polymer mix within the main bore 42 to facilitate inversion of the polymer, in step 96. As noted above, the water may flow into the main bore 42 at one axial and/or circumferential position, while the polymer may flow into the main bore 42 at another axial and/or circumferential position of the main bore 42.

Furthermore, in some embodiments, the polymer injection assembly 33 may include the polymer injection choke valve 40, 62. Thus, the method may include flowing the polymer toward the main bore 42 via the polymer injection choke valve 40, 62. Additionally, the polymer injection choke valve 40, 62 may be controlled to adjust a flow rate of the polymer and/or a pressure at each location at which the polymer is injected into the main bore 42. In some embodiments, the polymer injection assembly 33 is configured to flow the polymer into the annulus 60 of the tree 28 and/or the well head 32. Thus, the method may including flowing the polymer into the annulus 60 of the tree 28 and/or the well head 32 and subsequently flowing the polymer into the main bore 42 via the radial conduit 64. As noted above, in some cases, the polymer injection assembly 33 may be configured to flow the polymer into the main bore 42 at multiple axial and/or circumferential positions (e.g., via multiple polymer injection choke valves 40 or the multiple radial conduits 64). Thus, the method may include flowing the polymer into the main bore 42 at one or more additional (e.g., third, fourth, etc.) axial and/or circumferential positions of the main bore 42. As discussed above, the water injection assembly 23 and the polymer injection assembly 33 enable separate (e.g., independent) injection of the water and the polymer into the main bore 42, and therefore, the water and the polymer do not mix prior to injection into the main bore 42. Furthermore, the polymer flows into the main bore 42 in the non-inverted state or a substantially non-inverted state, and degradation of the polymer is thereby limited during supply and injection of the polymer into the main bore 42.

As noted above, in some cases, a controller may be coupled to and may control an actuator that adjusts the water injection choke valve 26, and/or the dedicated polymer connection 30, a flow rate of the water through the water injection line 22 (e.g., via one or more valves or flow control devices), and/or a flow rate of the polymer through the polymer injection line 24 (e.g., via one or more valves or flow control devices) to control and/or to facilitate mixing and inversion of the polymer. The controller disclosed herein may be an electronic controller having electrical circuitry configured to process data from one or more sensors and/or other components of the system 8. The controller includes a processor and a memory device. The controller may also include one or more storage devices and/or other suitable components. The processor may be used to execute software, such as software for controlling actuators, the flow rates, and so forth. The memory device may include a volatile memory, such as random access memory (RAM), and/or a nonvolatile memory, such as ROM. The memory device may store a variety of information and may be used for various purposes. For example, the memory device may store processor-executable instructions (e.g., firmware or software) for the processor to execute, such as instructions for controlling actuators, the flow rates, and so forth. The storage device(s) (e.g., nonvolatile storage) may include read-only memory (ROM), flash memory, a hard drive, or any other suitable optical, magnetic, or solid-state storage medium, or a combination thereof. The storage device(s) may store data (e.g., polymer characteristics, inversion times, flow rates, etc.), instructions (e.g., software or firmware for controlling components of the system 8, etc.), and any other suitable data.

Figure 6:
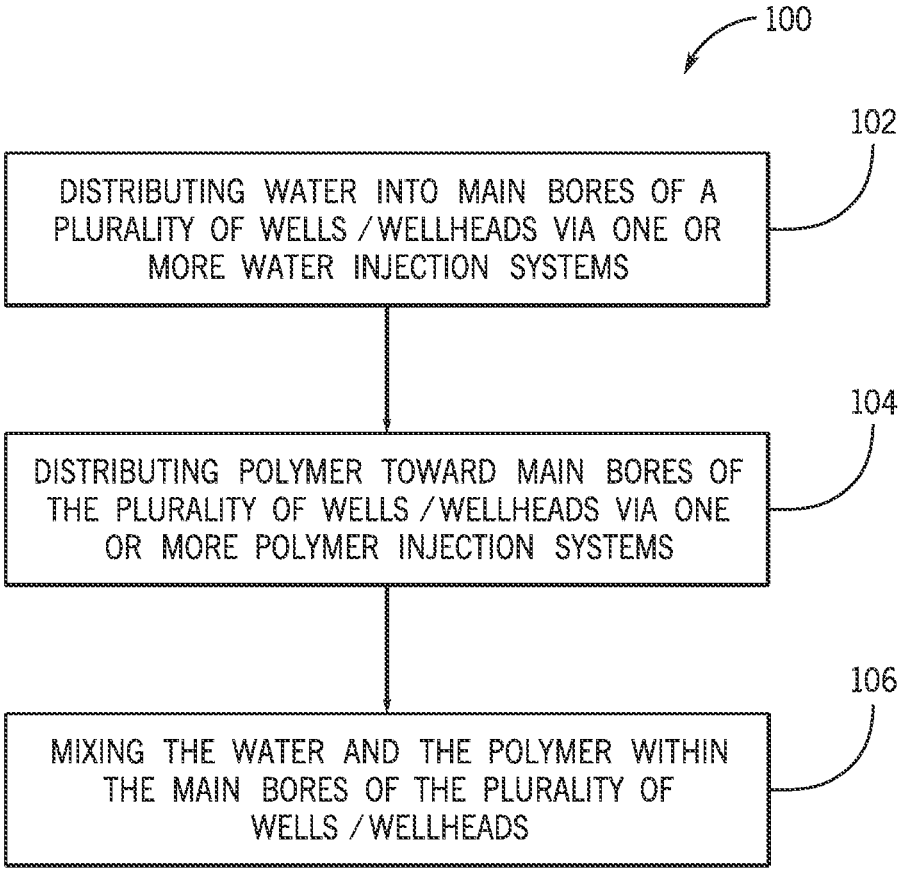
FIG. 6 is a flow diagram of an embodiment of a method for injecting a polymer into a plurality of wells.

FIG. 6 is a flow diagram of an embodiment of a method 100 for injecting the polymer into a plurality of wells 20, e.g., in an oilfield. The method 100 of FIG. 6 is similar to the method 90 of FIG. 5, except that the method 100 relates to a plurality of wells 20. Therefore, the foregoing discussion pertaining to FIG. 5 generally applies to the embodiment of FIG. 6 as well. In step 102 of the illustrated embodiment, the method 100 includes flowing or distributing water into main bores of a plurality of wells 20 and/or well heads 32 via one or more water injection systems (e.g., water injection assemblies 23). In step 104 of the illustrated embodiment, the method 100 includes flowing or distributing polymer (e.g., in a non-inverted state or a substantially non-inverted state) toward main bores of the plurality of wells 20 and/or well heads 32 via one or more polymer injection systems (e.g., polymer injection assemblies 33). In step 106, the method 100 includes mixing the water and the polymer within the main bores of the plurality of wells 20 and/or well heads 32, thereby facilitating inversion of the polymer. In each of the plurality of wells 20 and/or well heads 32, the water may flow into the main bore 42 at one axial and/or circumferential position, while the polymer may flow into the main bore 42 at another axial and/or circumferential position of the main bore 42.

In certain embodiments, the method may distribute the water and/or the polymer to one, all, or a subset of the plurality of wells 20 and/or well heads 32 via a common water injection system and/or a common polymer injection system. For example, the common water injection system may include a common header or water distribution unit, which distributes the water through a plurality of conduits to the plurality of wells 20 and/or well heads 32. Likewise, the common polymer injection system may include a common header or polymer distribution unit, which distributes the polymer through a plurality of conduits to the plurality of wells 20 and/or well heads 32. The water distribution unit and the polymer distribution unit may be located on-site or remote relative to the plurality of wells 20 and/or well heads 32. For example, the water distribution unit and the polymer distribution unit may be mounted to a topside facility. The method may provide common control (e.g., via a common valve) and/or independent control (e.g., via independent valves in each conduit) of the water flow to the plurality of wells 20 and/or well heads 32. Likewise, the method may provide common control (e.g., via a common valve) and/or independent control (e.g., via independent valves in each conduit) of the polymer flow to the plurality of wells 20 and/or well heads 32. The method may include operation of a controller (e.g., a processor-based controller) coupled to the various valves and sensors distributed through the wells 20 and/or well heads 32, thereby enabling control of the flow rates and pressures of the water and polymer delivered to each of the plurality of wells 20 and/or well heads 32. For example, the method may operate the controller to tailor the flow of water and polymer to each of the plurality of wells 20 and/or well heads 32 based on various characteristics or conditions in each of the plurality of wells 20 and/or well heads 32.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A fluid injection system, comprising:

a well head comprising an annulus circumferentially surrounding a main bore, wherein the annulus is fluidly coupled to the main bore via one or more radial conduits formed in an annular wall that defines the main bore;

a water injection assembly, comprising:

a choke valve configured to receive water from a water injection line and to provide the water to the main bore of the well head; and a polymer injection assembly, comprising:

a dedicated polymer connection configured to receive a polymer from a polymer injection line and to direct the polymer to the annulus of the well head to enable the polymer to flow through the one or more radial conduits to the main bore to facilitate mixing of the water and the polymer within the main bore.

2. The system of claim 1, wherein the polymer is provided to the main bore of the well head in a substantially non-inverted state.

3. The system of claim 1, wherein the dedicated polymer connection comprises a polymer injection choke valve configured to regulate flow of the polymer from the polymer injection line into the annulus.

4. The system of claim 1, wherein the dedicated polymer connection comprises a plurality of polymer injection choke valves configured to direct the polymer into the annulus at a plurality of discrete axial locations of the annulus.

5. The system of claim 1, wherein the one or more radial conduits comprise a plurality of axially-spaced radial conduits fluidly coupling the annulus to the main bore to facilitate flow of the polymer from the annulus into the main bore at multiple axial locations of the main bore.

6. The system of claim 1, wherein the water injection assembly is configured to inject the water into the main bore at a first axial location and the polymer injection assembly is configured to inject the polymer into the main bore through a first radial conduit of the one or more radial conduits that is positioned at a second axial location downstream from the first axial location.

7. The system of claim 1, wherein the water injection assembly comprises a fluid conduit that extends from an outlet of the choke valve and through the annular wall that defines the main bore to enable the water injection assembly to inject the water into the main bore in a radial direction.

8. The system of claim 7, wherein the fluid conduit is positioned radially across the main bore from at least one radial conduit of the one or more radial conduits.

9. The system of claim 1, wherein a first radial conduit of the one or more radial conduits is positioned radially across the main bore from a second radial conduit of the one or more radial conduits.

10. A fluid injection system, comprising:

a polymer injection assembly, comprising:

a polymer injection line configured to receive a flow of a substantially non-inverted polymer from a polymer supply;

a dedicated polymer connection coupled to the polymer injection line and to a tree of a well head, wherein the dedicated polymer connection is configured to receive the flow of the substantially non-inverted polymer from the polymer injection line and to facilitate distribution of the substantially non-inverted polymer into a main bore of the well head at multiple discrete axial or circumferential locations of the main bore, wherein the dedicated polymer connection is configured to provide the polymer to an annulus of the well head, the annulus circumferentially surrounds the main bore, and one or more radial conduits comprise a plurality of radial conduits formed in an annular wall that defines the main bore to fluidly couple the annulus to the main bore to facilitate distribution of the polymer into the main bore at the multiple discrete axial or circumferential locations of the main bore.

11. The system of claim 10, comprising a water injection assembly configured to provide water to the main bore of the well head to facilitate inversion of the polymer within the main bore, wherein the water injection assembly is configured to inject the water into the main bore at a first axial location and the polymer injection assembly is configured to facilitate injection of the polymer into the main bore at a second axial location downstream from the first axial location.

12. The system of claim 10, wherein the dedicated polymer connection comprises a plurality of polymer conduits that extend from respective outlets of respective choke valves to the tree of the well head to facilitate distribution of the substantially non-inverted polymer into the main bore at the multiple discrete axial or circumferential locations of the main bore.

13. The system of claim 12, wherein at least one of the plurality of polymer conduits is oriented at an angle relative to a radial axis of the well head to enable injection of the substantially non-inverted polymer into the main bore in an upstream flow direction or in a circumferential flow direction.

14. A method, comprising:

independently flowing a first fluid, via a first fluid injection assembly, into a first main bore of a first well head;

independently flowing a substantially non-inverted polymer, via a first polymer injection assembly, from a polymer distribution unit into an annulus of the first well head that circumferentially surrounds the first main bore of the first well head, and subsequently flowing the substantially non-inverted polymer into the first main bore via a radial conduit extending radially through an annular wall that is positioned between the annulus and the first main bore; and mixing the first fluid and the substantially non-inverted polymer within the first main bore to facilitate inversion of the polymer within the first main bore.

15. The method of claim 14, comprising flowing the first fluid into the first main bore at a first axial location of the first main bore and flowing the substantially non-inverted polymer into the first main bore at a second axial location downstream of the first axial location.

16. The method of claim 14, comprising flowing the substantially non-inverted polymer through a polymer injection choke valve into the annulus, and controlling the polymer injection choke valve to adjust a flow rate of the substantially non-inverted polymer into the annulus.

17. The method of claim 14, comprising isolating the substantially non-inverted polymer from the first fluid until the substantially non-inverted polymer flows into the first main bore.

18. The method of claim 14, comprising:

independently flowing the first fluid, via a second fluid injection assembly, into a second main bore of a second well head;

independently flowing the substantially non-inverted polymer, via a second polymer injection assembly, from the polymer distribution unit toward the second main bore; and mixing the first fluid and the substantially non-inverted polymer within the second main bore to facilitate inversion of the polymer within the second main bore.

* * * * *